United States Patent [19]

Toomey, Jr.

[11] Patent Number: 4,670,111

[45] Date of Patent: Jun. 2, 1987

[54] ELECTROCHEMICAL DIMERIZATIONS OF PYRIDINIUM SALTS

[75] Inventor: Joseph E. Toomey, Jr., Indianapolis, Ind.

[73] Assignee: Reilly Tar & Chemical Corp., Indianapolis, Ind.

[21] Appl. No.: 797,453

[22] Filed: Nov. 13, 1985

[51] Int. Cl.[4] ..... C25G 3/00

[52] U.S. Cl. ..... 204/73 A; 204/72; 204/73 R; 204/74

[58] Field of Search ..... 204/72, 73 R, 73 A, 204/74, 59 R

[56] References Cited

U.S. PATENT DOCUMENTS

| | | | |
|---|---|---|---|
| 2,273,796 | 2/1942 | Heise et al. | 204/74 |
| 3,478,042 | 11/1969 | Colchester et al. | 204/296 |
| 4,176,020 | 11/1979 | Misumi et al. | 204/72 |
| 4,482,437 | 11/1984 | Toomey | 204/74 |
| 4,482,439 | 11/1984 | Toomey | 204/78 |

OTHER PUBLICATIONS

Bruno Emmert, "Const. of the Dialkyltetrahydrodipyridyls Discovered by A. W. Hofmann", Ber. 52B, 1351–3 (1919).

Bruno Emmert, "A Radical w. Quadrivalent N."Ber. 53B, 370–7 (1920).

Bruno Emmert, "Electrolysis of Quaternary Pyridinium and Quinolinium Salts", Ber. 42, 1997–9 (1909).

"Organic Electrosynthesis", by R. Jansson, Chem. & Eng. News, 11/19/84.

*Primary Examiner*—R. L. Andrews

*Attorney, Agent, or Firm*—Woodard, Weikart, Emhardt & Naughton

[57] ABSTRACT

An improved electrochemical dimerization of a N-substituted pyridinium salt to its corresponding N,N'-disubstituted 4,4'-tetrahydrobipyridine in a flow cell at a high-surface-area cathode, employing an ion-exchange membrane divider and an alkaline catholyte solution. Isolation and recovery of the resultant product are reported in significant yields are reported without the use of an extracting solvent or corrosion or other additive either in the catholyte solution or in any subsequent operation.

15 Claims, No Drawings

ELECTROCHEMICAL DIMERIZATIONS OF PYRIDINIUM SALTS

BACKGROUND OF THE INVENTION

This invention concerns generally the field of pyridine chemistry, and particularly an improved electrochemical process for preparing N,N'-disubstituted-4,4'-tetrahydrobipyridines through direct reduction of their precursor pyridinium salts in commercially practicable flow cells using high-surface-area cathodes.

An early reported synthesis of these compounds was by direct dimerization of an N-alkylpyridinium salt with sodium amalgum to form N,N'-dialkyl-4,4'-tetrahydrobipyridine. This product was then oxidized to the corresponding N,N'-dialkyl diquaternary salt. Bruno Emmert, "Constitution of the dialkyltetrahydrodipyridyls discovered by A. W. Hofmann," Ber. 52B, 1351–3 (1919); Bruno Emmert, "A radical with quadrivalent nitrogen," Ber. 53B, 370–7 (1920). Another investigation also by Emmert reported the direct electrolysis of N-alkylpyridinium salts to their corresponding N,N'-dialkyl-4,4'-tetrahydrobipyridines in an alkaline solution, also with subsequent oxidation to afford the same N,N'-disubstituted bipyridinium compounds. Bruno Emmert, "Electrolysis of Quaternary Pyridinium and Quinolinium Salts," Ber., 42, 1997–9 (1909).

This electrochemical approach was and is highly appealing as a simple and direct method whereby these tetrahydrobipyridines and their oxidized bipyridinium salts can be obtained while observing moderate conditions and generally without the need for dangerous or noxious substances. Unfortunately, such electrochemical reactions have suffered over the years largely due to problems of commercial practicability. Cell design technology has been slow to advance, and the degree of conversion and yield of targeted products has often been too low for commercial viability.

The field of organic electrochemistry has received renewed attention in the past decade, however, in part as chemical companies have shifted toward more highly functionalized and higher valued products. These N,N'-disubstituted-4,4'-tetrahydrobipyridines are clearly caught up in this resurgence.

For example, in the late 1960's U.S. Pat. No. 3,478,042 to Imperial Chemical Industries Ltd. (ICI) reported an improved method for preparing these compounds by conducting the electrolysis in a glass beaker-type cell using planar electrodes and a diaphragm separator with extraction in situ of the tetrahydropyridine by means of an organic solvent such as diethyl ether, hexane, octane or others added to the catholyte solution. Conversion of the pyridinium salt was reported at 10%, with yield of the targeted tetrahydrobipyridine product reported as equivalent to a current efficiency of 90%. A reported problem with ICI's method, however, has been that conversions cannot be achieved much beyond this 10% level without damaging deposits forming on the electrode surface thereby making continued operation impractical and isolation of the product tedious. Also, an organic extracting agent is expensive, highly flammable, and adds extra unwanted steps to the process. The use of stirred-tank cells also makes such processing uneconomic because productivity is so low.

More recently, U.S. Pat. No. 4,176,020 to Asahi Kasei Kogyo Kabushiki Kaisha (Asahi) reported an improvement of ICI's process utilizing a two- or three-chamber electrolytic vat and aqueous catholyte with no extracting solvent in the catholyte solution. The Asahi patent still requires, however, that extraction of the liquid coming from the cathode chamber take place in a subsequent operation with the organic solvent having been removed to an outside reservoir. This poses continuing problems with Asahi's process as even the external extracting solvent keeps the cost of production high, the necessity remains for separating the aqueous phase cleanly from the organic phase before recycling to the cell, and the linear velocity of electrolyte in the cell is high thereby increasing the pumping and manufacturing costs. The use of flat or planar electrodes is also undesirable as their surfaces must be kept clean and their productivities are low compared to applicant's invention herein.

Regardless of their method of synthesis, once formed these tetrahydrobipyridines exhibit effective properties as oxygen scavengers, as acid-gas scavengers, e.g., of carbon dioxide or hydrogen sulfide, and as anti-corrosion additives. They can also be readily oxidized to diquaternary salts of 4,4'-bipyridines or to 4,4'-bipyridines themselves, many of which exhibit effective herbicidal properties and have gained extensive worldwide use. Principal among these compounds is N,N'-dimethyl-4,4'-bipyridinium dichloride which is commonly referred to by the trademark PARAQUAT®. For a general report on the synthesis of these diquaternary salts of bipyridine compounds, see L. A. Summers, "The Bipyridinium Herbicides," Academic Press, NY, pp. 69–91, 1980.

SUMMARY OF THE INVENTION

Applicant's invention addresses the inadequacies in prior art methods for synthesis of these N,N'-disubstituted-4,4'-tetrahydrobipyridines and provides an improved electrochemical process for their preparation by directly dimerizing their precursor N-substituted pyridinium salts in commercially practicable flow cells. In so doing, applicant's preferred electro-reductions have achieved significant conversions and yields of the desired products by use of high-surface area cathodes, preferably of lead or lead alloys, conducted in an alkaline medium and without the necessity of extracting solvents or corrosive or other additives as found in the art. Applicant's invention encompasses batch, semi-continuous and continuous processes, and his preferred flow cells are not restricted as to particular design geometries, with factors such as electrolyzer feed rate and preparation, product isolation, user need and the like governing the particular design and processing used.

Related objects and advantages of the present invention will be apparent from the following description.

DESCRIPTION OF THE PREFERRED EMBODIMENT

For the purpose of promoting an understanding of the principles of this invention, reference will now be made to one embodiment and specific language will be used to describe the same. It will nevertheless be understood that no limitation of the scope of the invention is thereby intended, such alterations and further modifications in the devices, and such further applications of the principles of the invention as illustrated herein being contemplated as would normally occur to one skilled in the art to which the invention relates.

In accordance with the above summary, applicant has discovered and proven in one preferred embodiment of his invention that electrochemical dimerizations of N-substituted pyridinium salts to their corresponding N,N'-disubstituted-4,4'-tetrahydrobipyridines are successfully performed in high percentages of conversion and yield with definite commercial and industrial applications using flow cells equipped with high-surface-area cathodes. Most preferred have been cells of a filter-press arrangement having lead or lead alloy three-dimensional cathodes, and being equipped with an ion-exchange membrane divider in contrast to ceramic and other diaphragms often found in the art. An alkaline catholyte solution has been preferred, and one aspect of applicant's discovery has been that conversions and yields both in excess of about 90% have been achieved without the necessity of an extracting solvent being used either in the catholyte or in any subsequent isolation procedure.

As used in the application, phrases such as "electrochemical dimerization," "electro-reduction" and the like are meant to include all possible variations as to reaction conditions and the like which are known to those of ordinary skill in the art to which applicant's invention pertains. The only exceptions to this relate to any specific conditions or features which have shown to be required from applicant's testing to data as are further detailed herein. In addition, the phrase "flow cell" is meant to be restrictive only in the sense of excluding any cell consisting of a tank, beaker or container of similar function which is employed as a mixed or unmixed electrolyzer and which is limited by the inability to achieve a substantially plug flow of a electrolyte in the reactor, by the inability to obtain a high space-time yield consistent with more sophisticated electrolyzers, or by the inability to effectively use ion-exchange membranes which are most often conveniently made and purchased in sheet form. In so doing, the phrase "flow cell" is meant to include all other electrolyzers which may employ either a batch or continuous mode of operation with a substantially plug flow of solution through the reactor and which can be conveniently constructed as filter-press, disc-stack, or concentric tube cells. For example, this includes both batch reactors where the electrolyte is continually recirculated through the closed loop as well as continuous processes where stead-state conditions are approached and/or product is continually removed and the electrolyte regenerated for further use. No cell geometries are excluded from the scope and intent of applicant's invention so long as they comply with these fluid-flow characteristics.

With any particular starting material, the choice of reactor and operational mode for use with applicant's invention varies in view of the chemistry involved, both as to reaction conditions which must be observed as well as other factors affecting product separation, purification, and the like. Applicant's preferred electrochemical flow cell to date is his own filter press cell which is the subject of a copending U.S. patent application, Ser. No. 670,331, and entitled FILTER PRESS ELECTROCHEMICAL CELL WITH IMPROVED FLUID DISTRIBUTION SYSTEM. Accordingly, this prior application is hereby incorporated by reference in its entirety as to all pertinent and relevant aspects thereof relating to prior cell design technology and to the disclosure and understanding of applicant's preferred flow cell as used herein.

As to specific starting materials, applicant's preferred process is applicable to the same N-substituted pyridinium salts which have been reported or are otherwise known or susceptible of electrolytic dimerization to produce their corresponding N,N'-disubstituted-4,4'-tetrahydrobipyridine products. Most preferred within this definition are N-alkylpyridinium salts in which the alkyl group has 1 to about 6 carbon atoms, most preferred being the methyl form. Other suitable starting materials include those having as the N-substituent a form such as —CO—R, —OR, or —NRR, for example, where these radicals may independently be a hydrogen atom or an alkyl, aryl, alkaryl or acyl group having from 1 to about 6 carbon atoms. Still others covered by this definition may have further substitution on the pyridine ring at any but the 4-position, such side substituents similarly being an alkyl or other group having from 1 to about 6 carbon atoms with no detrimental effect on the electrolytic dimerization reaction. Some specific examples of suitable starting materials usable in applicant's preferred dimerization process, based on general knowledge in the art as well as experimental results to date, include N-methylpyridinium salts, N-acetylpyridinium salts, and N-carboamoylpyridinium salts.

In all such cases, the anion comprising the salt in these starting materials is most preferably a halide such as $Cl^-$, $Br^-$, or $I^-$, a sulfate such as $CH_3OS_3^-$, $SO_4^=$, $RCO_2^-$, or any other suitable anion such as those presently reported by or known in the art. In this regard, reference can be made to any one of numerous sources for examples of such N-substituted pyridinium salts and their anions which are within the scope and intent of applicant's preferred starting material and his claimed invention herein.

Applicant's preferred high-surface-area cathodes used in these dimerizations to date have been made of copper or lead either alone or alloyed with, and possibly supported on, such materials as antimony, silver, copper, lead, mercury, cadmium, titanium, or carbon. Alternatively, other high-hydrogen-overvoltage materials, either in pure form or as alloys, can be used. Examples of physical embodiments of such three-dimensional or high-surface-area materials are wire meshes and metal particles such as spheres or other packing material, as well as those available in the art or discussed in more detail in applicant's electrochemical cell application previously incorporated herein by reference.

An alkaline catholyte solution has been preferred, comprising an aqueous solution of sodium carbonate or other suitable equivalent as are also well known to those skilled in this field. Most preferred has been a combination of about 2–4 wt% odium carbonate and 0.5–1.0 wt% sodium chloride. Aqueous sodium carbonate has served as the anolyte in applicant's experiments to date, although other suitable anolyte solutions are also well known and available.

The particular ion-exchange membrane divider used in a given embodiment of applicant's preferred process also depends in part upon the N-substituted pyridinium salt selected for dimerization. Suitable membrane dividers are once again well known and available to those in the art, one example being an Ionac MC3470 cation-exchange membrane divider marketed by the Sybron Chemical Division of Birmingham, N.J.

with regard to specific reaction conditions observed in applicant's electrodimerizations to date, cell temperatures have generally been maintained within a range of about 0°–85° C., with a range of about 15°–60° C. being most preferred from testing thus far performed. Preferred current densities have been held generally within a range of about 1–500 mA/cm$^2$, with a range of about 10–150 mA/cm$^2$ being most preferred. The concentration of N-substituted pyridinium salt starting material in the alkaline catholyte solution has preferably been maintained within a range of about 1–40 wt%, while most preferred has been a range of about 10–25 wt% of the salt in solution. The preferred anolyte concentration has been similar to that of the catholyte for a particular reaction, although concentration variants in both solutions may occur without significant detrimental effect to the dimerization reaction. Moreover, whether the given dimerization is a batch or continuous procedure will affect possible fluctuations in these concentrations. Applicant has also noted using his preferred flow cell that cell voltages have remained low and stable during more than 95% of the dimerization/reduction reactions thus far performed, and that no deposits of any kind have been noted on his preferred high-surface-area cathode materials.

Referring to their effectiveness, applicant's preferred dimerizations have shown significant results in excess of about 90% both conversion and yield of the starting material to the desired N,N'-disubstituted-4,4'-tetrahydrobipyridine product of the reaction. Isolation of this product has been simply and efficiently accomplished by merely separating and recovering the organic part of the two-phase catholyte solution using commonly known techniques. No extractive solvent has been required or used either in the catholyte solution or in any subsequent recovery operation. Therefore, applicant has avoided any hazard due to the flammability of such solvents as well as any increased production costs or extra procedures due to their presence. Significantly, no secondary deterioration of the dimer product has been noted in applicant's work in the absence of such solvents, unlike prior reports in the art.

Once recovered, these N,N'-disubstituted-4,4'-tetrahydrobipyridines are useful in view of their exhibited properties as corrosion inhibitors as well as scavengers for such things as oxygen, carbon dioxide, hydrogen sulfide, and others. They are also readily oxidized to their corresponding N,N'-disubstituted bipyridinium quaternary salts, such as PARAQUAT®, which have a long history of significant use as effective herbicides. In this regard, such subsequent oxidations can proceed by any of the known procedures in the art using oxygen-containing gases with or without the presence of catalysts, alcohols or other constituents, depending upon the particular prior art method chosen.

In addition to those individual advantages mentioned above, general benefits have been found to exist with applicant's preferred flow cell arrangements and processes as described in this application. These features include such things as the ability to continually remove heat from the flow cell as, for example, by circulating the electrolyte through a heat exchanger or similar apparatus during the process. Continual product removal and regeneration of the electrolyte is also possible as mentioned above, using standard and accepted procedures known to those of ordinary skill in the art with regard to the particular reaction involved.

Reference will now be made to specific examples for the purposes of further describing and understanding the features of applicant's preferred embodiments as well as their advantages and improvements over the art. In this regard, reference is made in Example 2 to a comparative process using a known prior art procedure. It is further understood that these examples are representative only, and that such additional embodiments and improvements of the same are within the contemplation and scope of applicant's invention as would occur to someone of ordinary skill in this art.

EXAMPLE 1

Preparation of N,N'-dimethyl-4,4'-tetrahydrobipyridine

A flow cell having an Ionac MC3470 cation-exchange membrane divider, a lead dioxide anode, and a packed-bed, high-surface-area cathode of lead shot was constructed and used in this experiment consistent with that disclosed in U.S. patent application, Ser. No. 670,331. The catholyte solution was prepared from the following: 12 wt% N-methylpyridinium chloride; 4 wt% sodium carbonate; and 0.5 wt% sodium chloride. Aqueous sodium carbonate was used as the anolyte solution. Charge was passed through the cell until conversion was substantially complete (approximately 1.2 F/mol), and the intense blue color initially formed in the aqueous phase of the catholyte during reduction was substantially gone. The two-phase catholyte solution was then separated, and analysis of the organic phase indicated both a 90–95% conversion and yield of N,N'-dimethyl-4,440 -tetrahydrobipyridine. During the electrolysis, cell voltages remained low and stable during at least 95% of the reduction.

The resultant tetrahydrobipyridine product was found to have satisfactory properties as an anti-corrosion additive and as a scavenger for such things as oxygen, hydrogen sulfide or carbon dioxide from hydrocarbon gas streams. Independently of this use, an amount of this isolated product was later catalytically oxidized in a nitrogen gas current containing approximately 15 wt % oxygen for about 4 hours. The yield of N,N'-dimethyl-4,4'-bipyridine dichloride, having known herbicidal properties, was thereafter determined polargraphically in an overall yield of 63% of the initial N-methylpyridinium chloride starting material.

EXAMPLE 2

Prior Art Preparation of N,N'-dimethyl-4,4'-tetrahydrobipyridine

In a comparison against the results of applicant's electro-dimerization as shown in Example 1, a single electrochemical cell arrangement was constructed using a planar, nonhigh-surface-area lead cathode with the other materials and conditions remaining the same. Electrolysis resulted in a low-current efficiency and low final yield of only about 5% while also exhibiting an ever-increasing cell voltage throughout the dimerizaton. Moreover, the planar cathode used was found to be coated with a yellow solid which inhibited the electrolysis. This solid did not form in applicant's high-surface-area cathode used in Examples 1, 3 and 4.

EXAMPLE 3

Preparation of N,N',2,2'-tetramethyl-4,4'-tetrahydrobipyridine

The procedure and apparatus in Example 1 was used except for substituting 1,2-dimethylpyridinium chloride for the N-methylpyridinium chloride used in Example 1. During electrolysis, an 85% current efficiency was exhibited and a 93% conversion of the precursor salt and a 91% yield of its corresponding dimer were found to have occurred. Simple isolation was possible without the use of an extracting solvent either in the catholyte or in a subsequent operation. As in Example 1, the dimer product exhibited the same utility and was readily oxidized to the dichloride form.

EXAMPLE 4

Preparation of N,N'-diacetyl-4,4'-tetrahydrobipyridine

The procedure of Example 1 was used where N-acetylpyridinium acetate was used instead of the N-methylpyridinium chloride. The resultant N,N'-diacetyl-4,4'-tetrahydrobipyridine was found in 93% yield and 98% current efficiency at 95% conversion of starting material.

What is claimed is:

1. In an electrochemical dimerization of an N-substituted pyridinium salt to its corresponding N,N'-disubstituted-4,4'-tetrahydrobipyridine product, the improvement comprising conducting the electrodimerization reaction in an alkaline medium in a flow cell having an ion-exchange membrane divider and a high-surface-area cathode.

2. The electrodimerization reaction in claim 1 in which said conducting is without the use of an extracting solvent in the alkaline medium.

3. The electrodimerization reaction in claim 1 additionally comprising the steps of isolating and recovering the N,N'-disubstituted-4,4'-tetrahydrobipyridine thereby formed, said conducting and said isolating and recovering further being without the use of an extracting solvent.

4. The electrodimerization reaction in claim 3 additionally comprising the step of maintaining the temperature of the alkaline medium between about 0°–85° C. and the current density between about 1–500 mA/cm$^2$ during said conducting.

5. The electrodimerizaion reaction in claim 1 additionally comprising the steps of isolating and recovering the N,N'-disubstituted-4,4'-tetrahydrobipyridine product thereby formed, said conducting being sufficient to achieve both at least a 90% conversion and yield of the precursor salt to the recovered product.

6. The electrodimerization reaction in claim 5 in which said conducting and said isolating and recovering are without the use of an extracting solvent.

7. The electrodimerization reaction in claim 6 additionally comprising the step of maintaining the temperature of the alkaline medium between about 15°–60° C. and the current density between about 10–150 mA/cm$^2$ during said conducting.

8. The electrodimerization reaction in claim 7 in which the precursor salt is a N-alkylpyridinium salt with the alkyl group having from 1 to about 6 carbon atoms.

9. The electrodimerization reaction in claim 7 in which the precursor salt is an N-methylpyridinium salt.

10. The electrodimerization reaction in claim 7 in which the precursor salt is an N-acetylpyridinium salt.

11. The electrodimerization reaction in claim 1 in which said conducting proceeds without any deposit being formed on the high-surface-area cathode to inhibit continued electrolysis.

12. An improved electrochemical dimerization reaction, comprising the steps of:

(a) combining an amount of a N-substituted pyridinium salt in an alkaline solution;

(b) charging this solution into the catholyte compartment of a flow cell having an ion-exchange membrane divider and a high-surface-area cathode;

(c) charging the anolyte compartment of the cell with an alkaline solution;

(d) conducting electrolysis in the cell sufficient to achieve both at least about a 90% conversion of the precursor salt and at least about a 90% yield of its corresponding N,N'-disubstituted-4,4'-tetrahydrobipyridine product; and (e) isolating and recovering the product thereby formed.

13. The electrodimerization reaction in claim 12 in which said conducting and said isolating and recovering are without the use of an extracting solvent.

14. The electrochemical dimerization reaction in claim 12 in which said conducting proceeds without any deposit being formed on the high-surface-area cathode to inhibit continued electrolysis.

15. The electrochemical dimerization reaction in claim 12 in which said isolating and recovering proceeds during said conducting, and additionally comprising the step of adding a further amount of the N-substituted pyridinium salt to the catholyte solution during said conducting to account for part or all of that which is consumed.

* * * * *